US010352332B2

(12) United States Patent
Stewart

(10) Patent No.: US 10,352,332 B2
(45) Date of Patent: Jul. 16, 2019

(54) CENTRIFUGAL PUMP WITH HIGH AND LOW INLET CONFIGURATIONS

(71) Applicant: CDS-John Blue Company, Huntsville, AL (US)

(72) Inventor: Jason T. Stewart, Harvest, AL (US)

(73) Assignee: CDS-John Blue Company, Huntsville, AL (US)

( * ) Notice: Subject to any disclaimer, the term of this patent is extended or adjusted under 35 U.S.C. 154(b) by 254 days.

(21) Appl. No.: 15/369,571

(22) Filed: Dec. 5, 2016

(65) Prior Publication Data

US 2017/0159673 A1 Jun. 8, 2017

Related U.S. Application Data

(60) Provisional application No. 62/263,281, filed on Dec. 4, 2015.

(51) Int. Cl.

| | |
|---|---|
| ***F04D 29/42*** | (2006.01) |
| ***F04D 9/02*** | (2006.01) |
| ***F04D 13/02*** | (2006.01) |
| ***F04D 15/00*** | (2006.01) |
| ***F04D 29/22*** | (2006.01) |

(52) U.S. Cl.

CPC ..... *F04D 29/4293* (2013.01); *F04D 9/02* (2013.01); *F04D 13/02* (2013.01); *F04D 15/0005* (2013.01); *F04D 29/22* (2013.01); *F04D 29/426* (2013.01)

(58) Field of Classification Search

CPC ..... F04D 29/22; F04D 29/426; F04D 29/466; F04D 29/4293; F04D 15/0005; F04D 9/02; F04D 13/02; F04D 1/00; F04D 29/4273; F04D 7/00; F04D 7/02

See application file for complete search history.

(56) References Cited

U.S. PATENT DOCUMENTS

| | | | | |
|---|---|---|---|---|
| 3,778,181 A * | 12/1973 | McFarlin | F04D 9/02 415/197 |
| 4,202,654 A * | 5/1980 | Marlow | F04D 7/04 415/113 |
| 4,726,734 A | 2/1988 | Zientek et al. | |
| 6,920,846 B2 * | 7/2005 | Pawellek | F01P 5/10 123/41.44 |
| 8,123,458 B2 | 2/2012 | Racer et al. | |

(Continued)

*Primary Examiner* — Dwayne J White
*Assistant Examiner* — Jackson N Gillenwaters
(74) *Attorney, Agent, or Firm* — Law Office of Mark Brown, LLC; Christopher M. DeBacker

(57) ABSTRACT

A reconfigurable pump includes a housing with inlet and outlet openings. An inlet adapter is mounted on the housing and includes an inlet passage communicating with the inlet opening. The inlet adapter is removably mounted on the housing and can be removed and repositioned for reconfiguring the pump between low-inlet and high-inlet configurations. In a low-inlet configuration the inlet passage is generally aligned with an impeller rotatably mounted in the housing. A check valve comprising a flapper valve is provided in the low-inlet configuration and prevents backflow. The flapper valve is removable for configuration in a high-inlet configuration with the inlet passage located generally above the impeller level. The inlet adapter can readily be repositioned from outside the pump housing between its low-inlet and high-inlet configurations.

16 Claims, 6 Drawing Sheets

(56) References Cited

U.S. PATENT DOCUMENTS

| | | | | |
|---|---|---|---|---|
| 8,128,340 | B2 | 3/2012 | Racer et al. | |
| 8,182,200 | B2 | 5/2012 | Cox | |
| 8,414,257 | B2 | 4/2013 | Scott et al. | |
| 2005/0013689 | A1* | 1/2005 | Racer | F04D 7/04 415/206 |
| 2015/0267714 | A1* | 9/2015 | Irwin | F04D 1/00 415/204 |
| 2016/0245291 | A1* | 8/2016 | Carnes | F04D 9/02 |
| 2016/0258340 | A1* | 9/2016 | Klippert | F01P 5/10 |

* cited by examiner

CENTRIFUGAL PUMP WITH HIGH AND LOW INLET CONFIGURATIONS

CROSS-REFERENCE TO RELATED APPLICATION

This application claims priority in U.S. Provisional Patent Application No. 62/263,281, filed Dec. 4, 2015, which is incorporated herein by reference.

BACKGROUND OF THE INVENTION

1. Field of the Invention

The present invention relates generally to rotational pumps, for example a self-priming, centrifugal pump. The centrifugal pump can easily be reconfigured between high and low inlet configurations.

2. Description of the Related Art

Rotational pumps are commonly used for pumping fluids in a wide variety of applications. Rotational pumps generally include centrifugal, vane, gear, turbine and other types. Self-priming operation is required for many applications. Back-flushing capability is preferable for pump maintenance in many applications.

These considerations are addressed by the present invention. Heretofore there has not been available a rotational, self-priming, user-reconfigurable pump with the advantages and features of the present invention.

SUMMARY OF THE INVENTION

A rotational, e.g., centrifugal, pump includes a reconfigurable inlet adapter allowing a user to quickly and easily transform the pump inlet between high and low inlet positions. In the high-inlet position water is contained below the inlet, thus flooding the impeller and self-priming the pump. Moreover, the pump can be back-flushed in its high-inlet configuration. However, the high-inlet configuration creates a diversion in the flow path through the pump, thus compromising efficiency and throughput.

On the other hand, in the low-inlet configuration, the flow path is more direct for optimal efficiency and throughput. Fluid can be contained within the pump when not in operation with a flapper valve, which acts as a check valve capturing a volume of water within the pump for self-priming when operation starts. However, the flapper check valve adds complexity in the low-inlet configuration, and interferes with back-flushing pump maintenance.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately-detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Low-Inlet Configuration Centrifugal Pump 2

Referring to the figures in more detail, FIGS. 1-4 show the pump 2 in a low-inlet configuration. The inlet adapter 4 can be removed and realigned to a high-inlet position, resulting in an alternative configuration of the centrifugal pump, which is designated 102, shown in FIGS. 5-8, and discussed in detail below.

Figure 1:
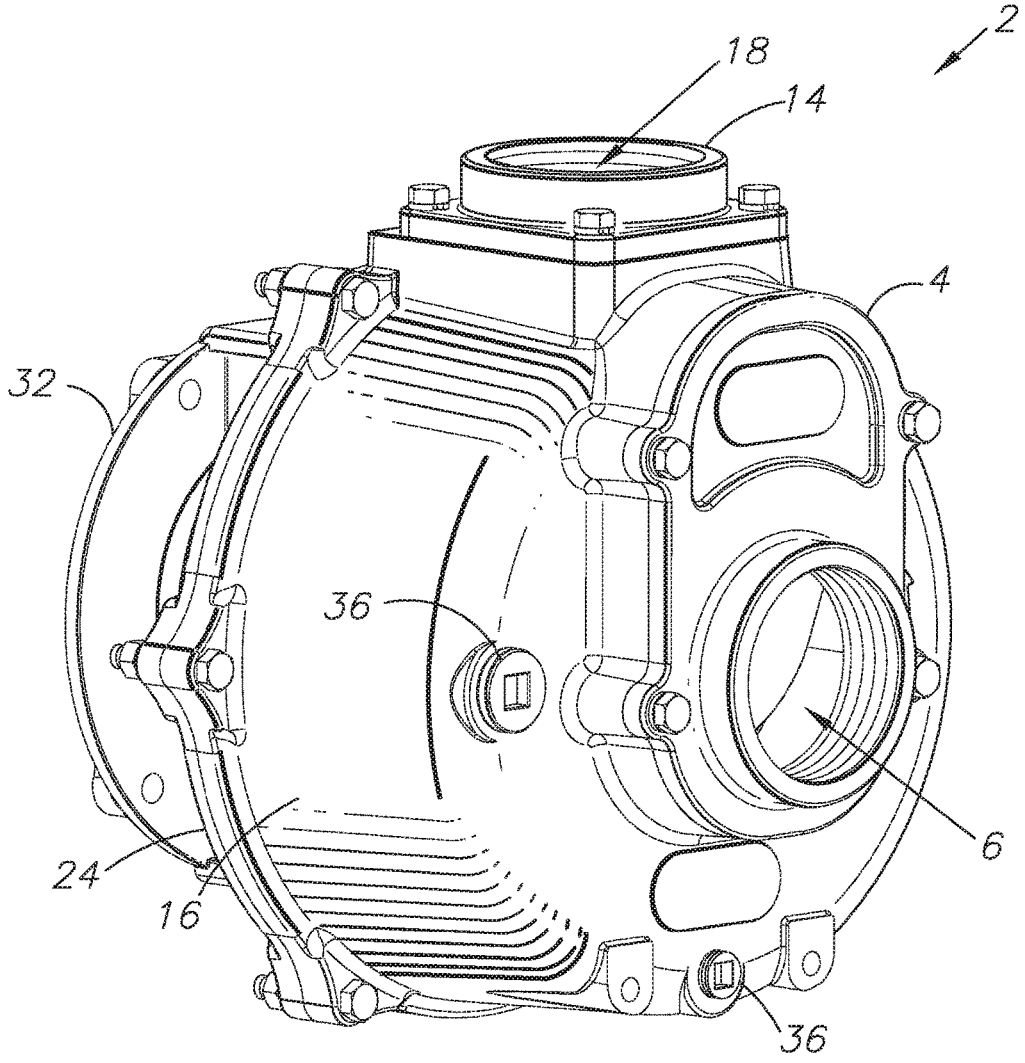
FIG. 1 is an inlet-side isometric view of the present invention in a low-inlet configuration.
Figure 3:
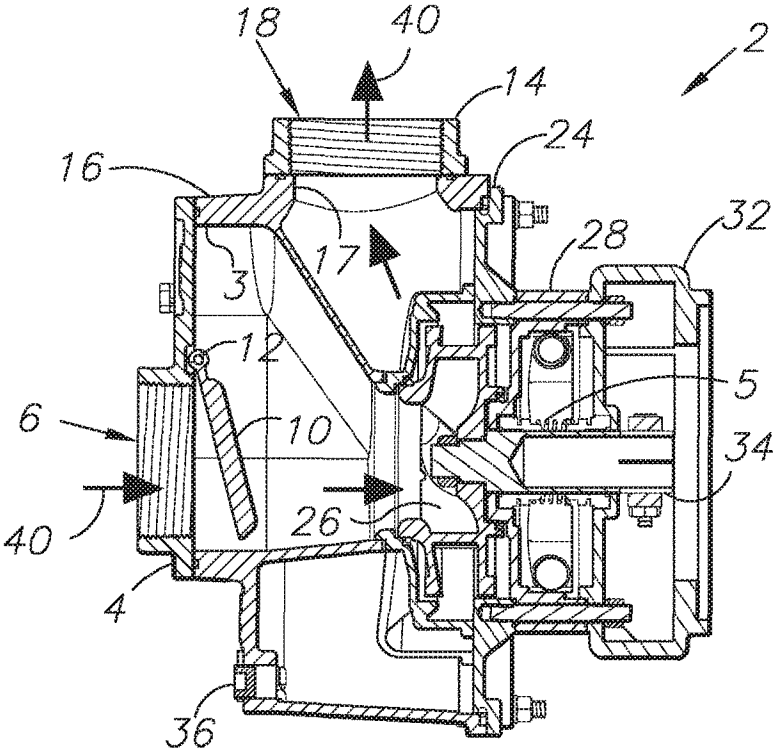
FIG. 3 is a side-sectional view thereof taken generally along line 3-3 in FIG. 2.
Figure 2:
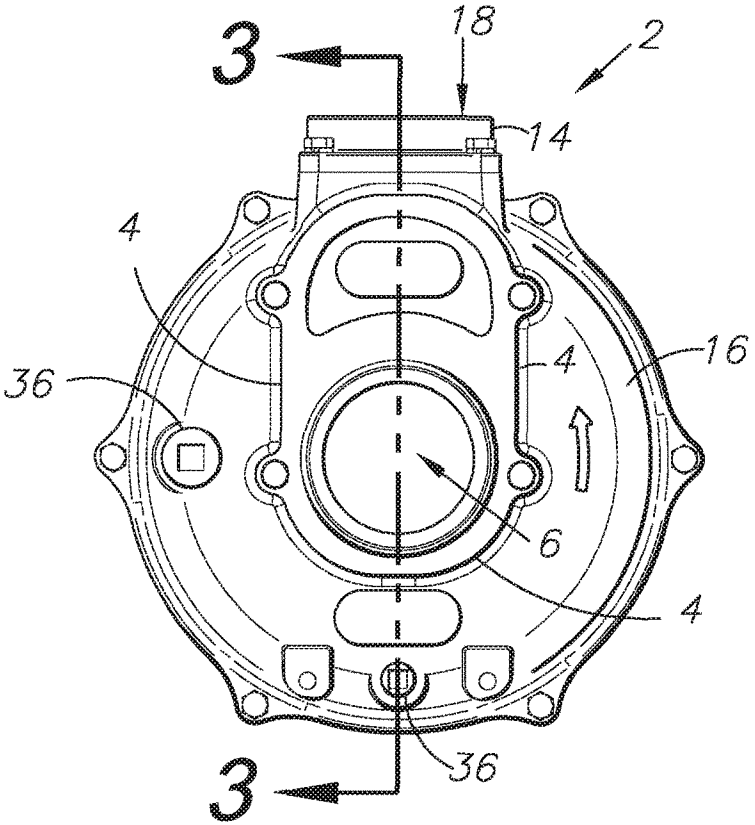
FIG. 2 is a front elevational view thereof.

As shown in FIG. 3, the pump 2 includes a housing 16 which has an inlet opening 3 covered by the inlet adapter 4 with a threaded inlet passage 6 leading into the housing 16 past an inlet check valve flap 10 pivotally mounted on a flap pivot pin 12. A discharge (outlet) flange 14 is mounted over a housing discharge (outlet) opening 17 on top of the housing 16 and includes a threaded discharge (outlet) passage 18.

Figure 4:
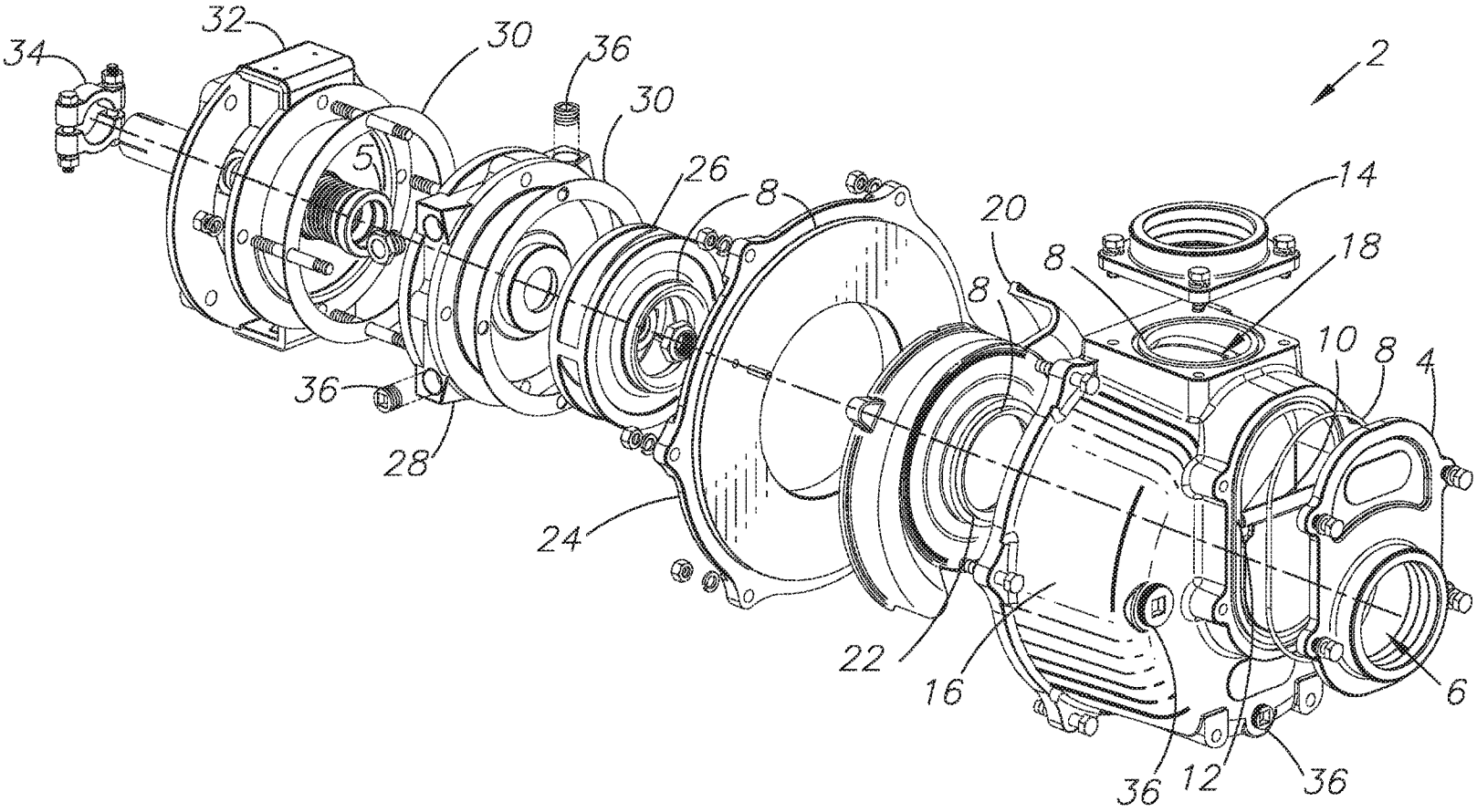
FIG. 4 is an exploded isometric view thereof.
Figure 5:
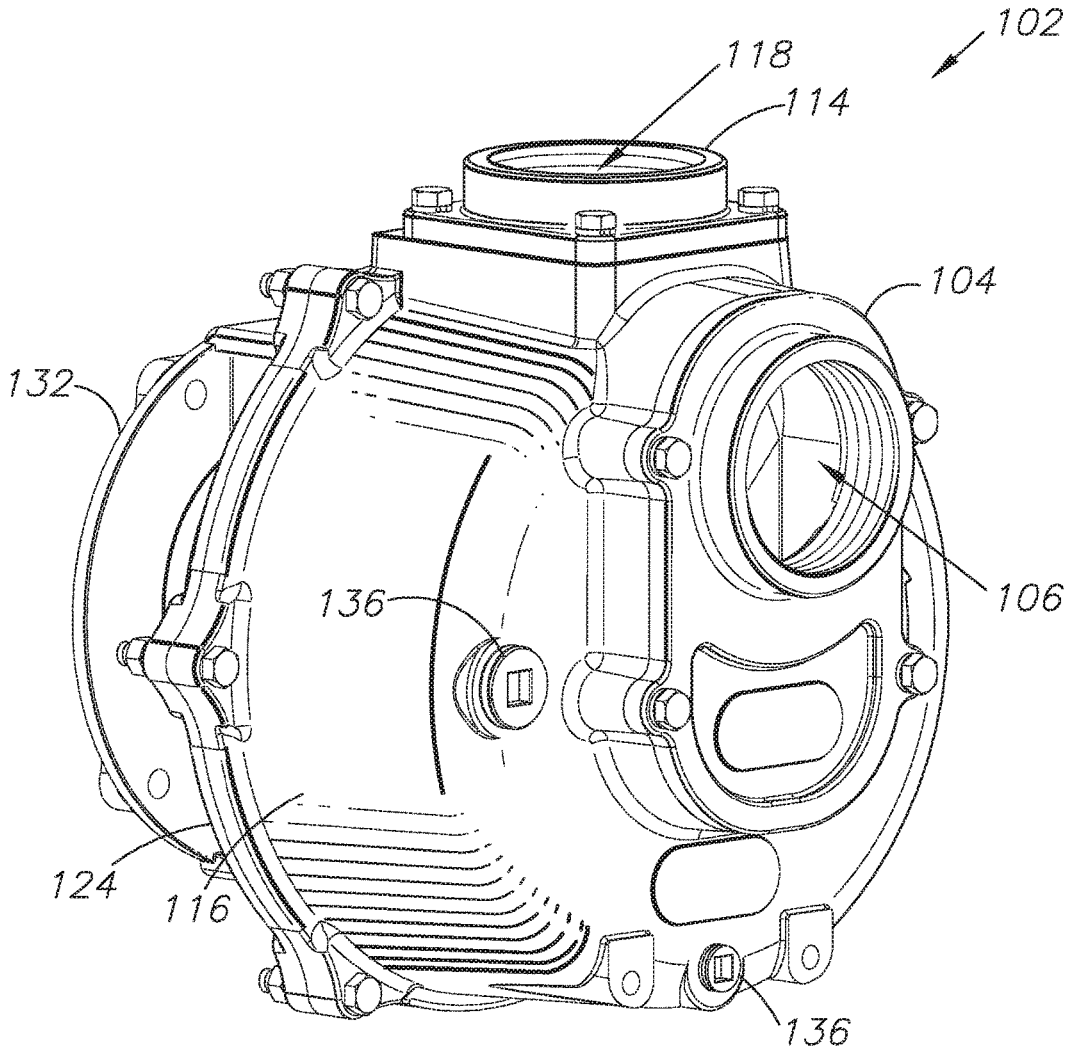
FIG. 5 is an inlet-side isometric view of the present invention in a high-inlet configuration.

As shown in FIG. 4, O-rings 8 and gaskets 30 are placed in the joints between the components of the pump 2 as necessary for maintaining water-tight integrity of the pump housing 16, including O-rings 8 between the inlet adapter 4 and the housing 16, and between the discharge flange 14 and the housing 16.

A scroll plate 20 is mounted within the pump housing 16. A scroll gasket 22 is clamped between the pump housing 16 and the scroll plate 20. A housing cover 24 encloses the pump housing 16. An impeller 26 is mounted in the pump 2. The impeller 26 connects to the scroll plate 20. A reservoir 28 is mounted about the impeller 26 and to the housing cover 24, with a gasket 30 located between the reservoir 28 and the housing cover 24. A rotary drive (e.g., engine or motor) adapter 32 is drivingly connected to the impeller 26 and is placed adjacent to the reservoir 28 with a gasket 30 placed between the two components. A mechanical double seal 5 is located therein. A clamp 34 secures this connection.

O-rings 8, or other suitable sealing means, can be installed between components of the pump 2 for maintaining water-tight integrity. Nominal pipe threaded (NPT) plugs 36 are inserted into plug holes within the housing 16 and the reservoir 28. The plugs 36 can be of varying sizes as required.

The low-inlet configuration of the pump 2, as described above, includes a backflow or check valve formed by the flapper 10. The low-inlet configuration optimizes fluid flow by providing a relatively direct path from the low-inlet passage 6 to the impeller 26. The high-inlet configuration pump 102 allows the outlet lines attached to the pump to drain when the pump 102 is not operating, while enabling self-priming with an internal quantity of fluid for instant pumping on start-up.

In operation, on activation the impeller 26 produces a pressure differential between the impeller 26 and mechanical seal 5. Fluid is pumped through the pump 2 along the flow path designated by flow arrows 40 (FIG. 3). Reducing fluid pressure on the seals can reduce wear and prolong useful life. A double wet seal design provides for continuous lubrication of the seal faces. This wet seal design allows the pump to be run dry for extended periods with no damage to the mechanical seal 5 faces.

III. High-Inlet Configuration Centrifugal Pump 102

FIGS. 5-8 show a high-inlet configuration of the centrifugal pump, which is designated 102. The inlet adapter 4 (designated 104 in its inverted, high-inlet configuration) is removable and can be inverted to transform the centrifugal pump from a low-inlet configuration (FIGS. 1-4) to a high-inlet configuration (FIGS. 5-8). The centrifugal pump of the present invention can thus be easily and quickly reconfigured between low-input and high-input configurations (2 and 102 respectively) for optimizing performance in particular applications. This dual-configuration feature enables users of the pump to select between the low-inlet 2 and the high-inlet 102 configurations.

As shown in FIGS. 5-8, a discharge (outlet) flange 114 is mounted on top of the housing 116 over a discharge (outlet) opening 117 and forms a threaded discharge (outlet) passage 118. A scroll plate 120 is mounted within the pump housing 116. A scroll gasket 122 is clamped between the pump housing 116 and the scroll plate 120. A housing cover 124 encloses the pump housing 116, which has an inlet opening 103. An impeller 126 is mounted in the pump 102. The impeller 126 connects to the scroll plate 120. A reservoir 128 is mounted about the impeller and to the housing cover 124, with a gasket 130 located between the reservoir 128 and the housing cover 124. A mechanical double seal 105 is located therein. A rotary drive (e.g., engine or motor) adapter 132 is drivingly connected to the impeller 126 and, like the engine adapter 32, is configured for connection to a rotating power source, such as an engine or a motor. The rotary drive adapter 132 is placed adjacent to the reservoir 128 with a gasket 130 placed between the two components. A mechanical double seal 105 is located therein. A clamp 134 secures this connection. NPT plugs 136 are inserted into plug holes within the housing 116 and the reservoir 128.

O-rings 108 and gaskets 130 are placed in the joints between the components of the pump 102 as necessary for maintaining water-tight integrity of the pump housing 116, including O-rings 108 between the inlet adapter 104 and the housing 116, and between the discharge flange 114 and the housing 116.

Figure 7:
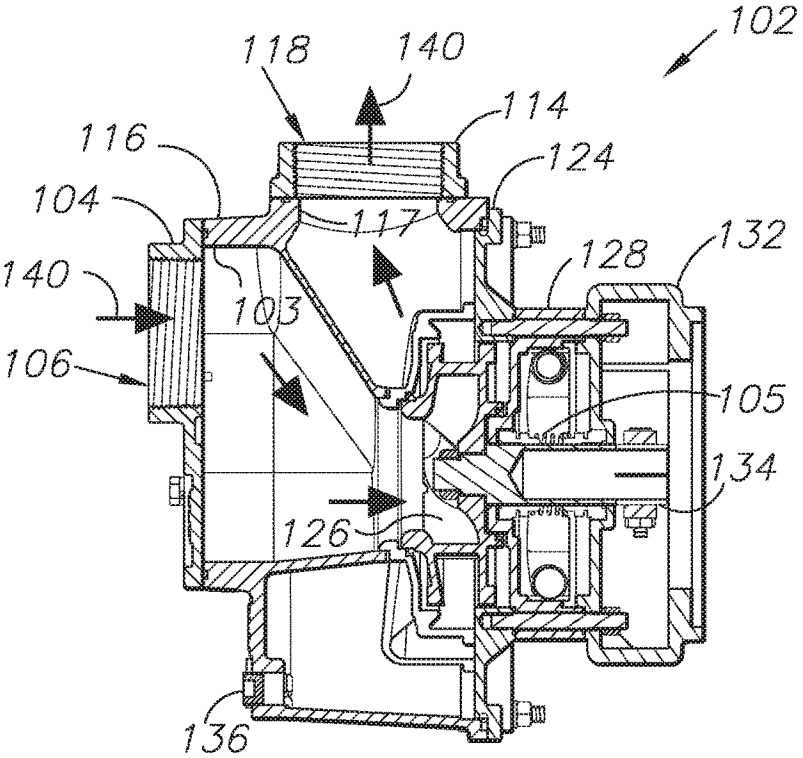
FIG. 7 is a side-sectional view thereof taken generally along line 7-7 in FIG. 6.
Figure 6:
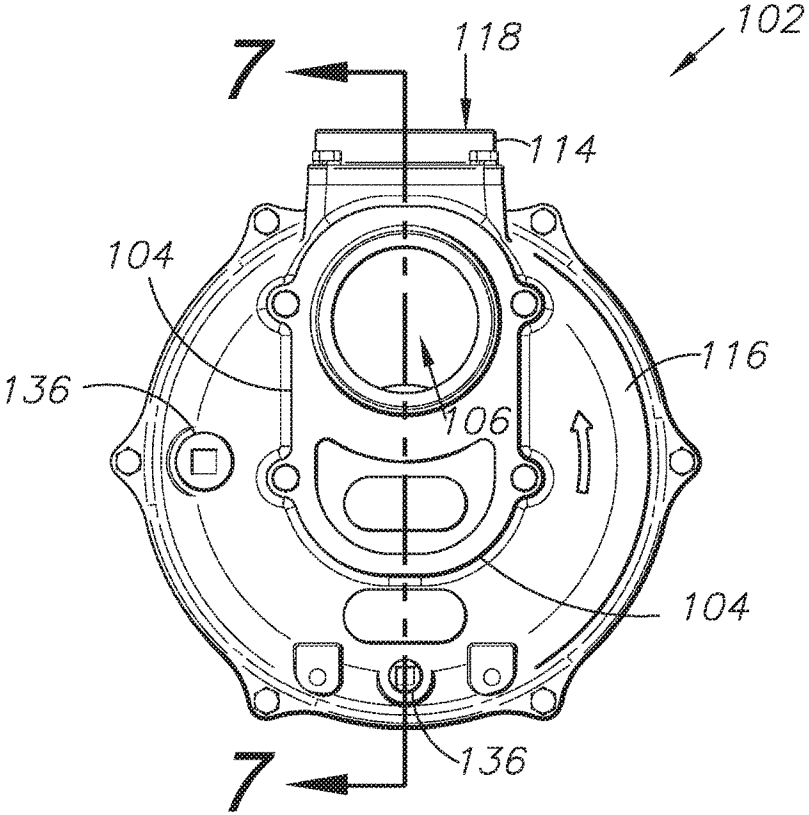
FIG. 6 is a front elevational view thereof.
Figure 8:
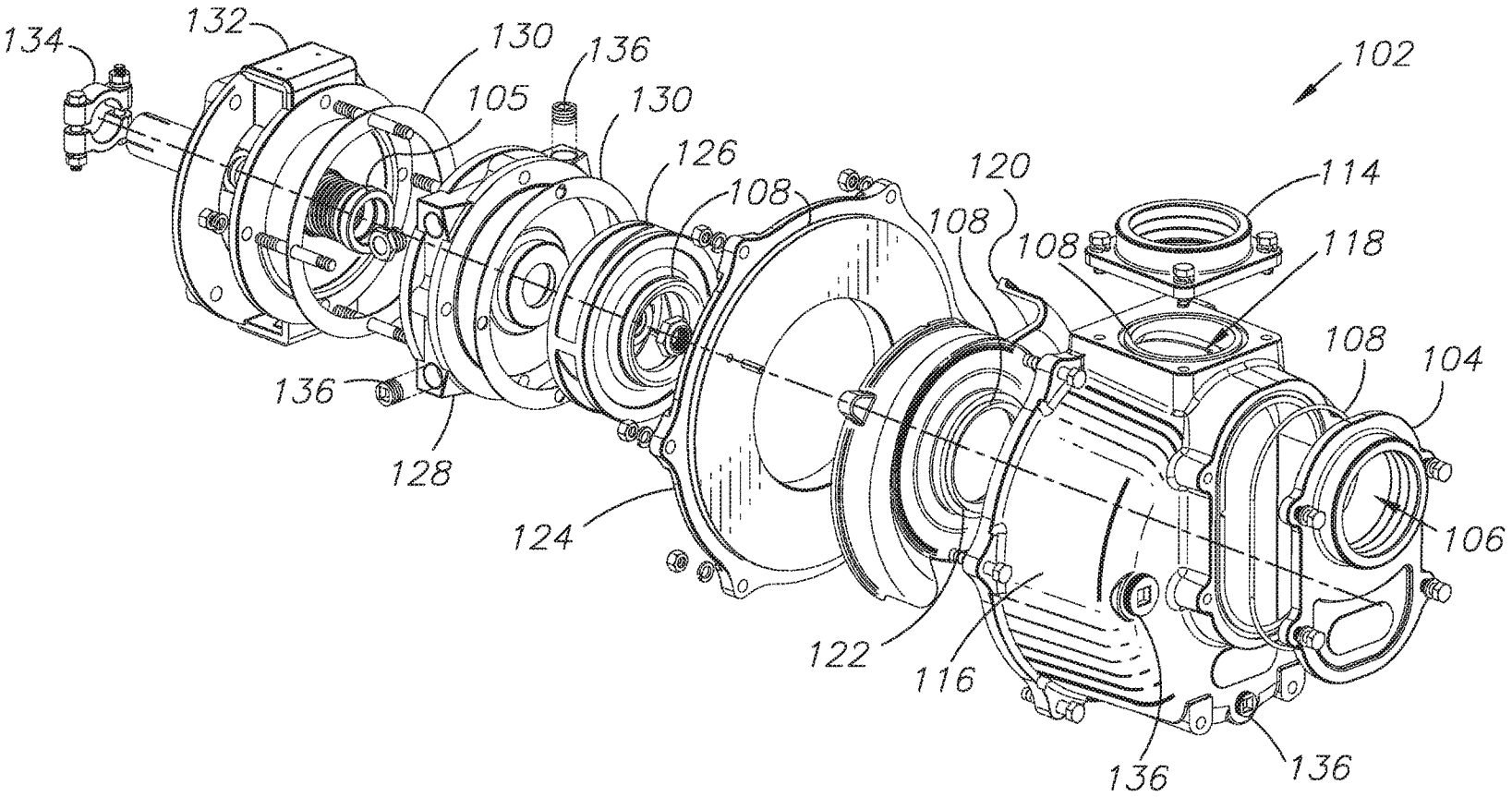
FIG. 8 is an exploded isometric view thereof.

In operation, the high-inlet configuration pump 102 is configured for retaining fluid below the inlet 106, thus flooding the impeller 126 and self-priming the pump 102 on startup. On activation the impeller 126 produces a pressure differential between the impeller 126 and mechanical seal 105. Fluid is pumped through the pump 102 along the flow path designated by flow arrows 140 (FIG. 7).

While an impeller-driven centrifugal pump with alternative configurations is shown and described, the present invention is not limited to any particular type of pump. Without limitation, other rotational pumps include vane, gear, turbine, screw and other types.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A reconfigurable pump with low-inlet and high-inlet configurations, the pump comprising:
- a housing with an exterior and an enclosed housing interior;
- an inlet opening from said housing exterior to said housing interior;
- a discharge opening from said housing interior to said housing exterior;
- a rotational component rotatably mounted in said housing interior and configured for pumping fluid from said inlet opening to said discharge opening;
- an inlet adapter mounted on said housing in covering relation over said inlet opening and selectively reconfigurable between a low-inlet configuration and a high-inlet configuration, wherein said inlet adapter is configured to be removed, inverted, and replaced; and
- said rotational component generally aligning with said inlet opening in said low-inlet configuration and generally being located below said inlet opening in said high-inlet configuration.

2. The reconfigurable pump according to claim 1 wherein said inlet adapter includes:
- first and second ends and an inlet passage located at one of said ends and communicating with said inlet opening; and
- said inlet adapter being configured for inverting between said low-inlet and said high-inlet configurations.

3. The reconfigurable pump according to claim 1, which includes:
- a check valve located in said housing interior and configured for blocking backflow through said inlet opening.

4. The reconfigurable pump according to claim 3, which includes:
- said check valve including a pivot pin extending transversely across said housing interior over said inlet opening and a flapper valve pivotally mounted on said pivot pin, said flapper valve having open and closed positions relative to said inlet opening.

5. The reconfigurable pump according to claim 4 wherein said flapper valve is configured for removal from said inlet adapter with said pump in its high-inlet configuration.

6. The reconfigurable pump according to claim 1, wherein said pump is selected from a list of pump types comprising: centrifugal; vane; gear; rotary; screw; roots-type; and turbine.

7. The reconfigurable pump according to claim 6, which includes:
- said pump type comprising a centrifugal pump;
- an impeller rotatably mounted in said housing interior;
- said impeller being configured for connection to a rotary power source; and said impeller being configured for pumping fluid from said inlet opening, through said housing interior and out said discharge opening.

8. The reconfigurable pump according to claim 7, which includes:

said inlet opening being located on a first end of said housing;

a rotary drive adapter connected to said impeller and located on a second end of said housing; and said rotary drive adapter being configured for connection to an engine or a motor.

9. The pump of claim 1, further comprising:

a discharge flange configured to be affixed to said pump housing over said discharge opening.

10. The pump of claim 7, further comprising:

a scroll plate located within said pump housing and connected to said impeller.

11. A reconfigurable pump with low-inlet and high-inlet configurations, the pump comprising:

a housing with an exterior and an enclosed housing interior;

an inlet opening from said housing exterior to said housing interior;

a discharge opening from said housing interior to said housing exterior;

a rotational component rotatably mounted in said housing interior and configured for pumping fluid from said inlet opening to said discharge opening;

an inlet adapter mounted on said housing in covering relation over said inlet opening and selectively reconfigurable between a low-inlet configuration and a high-inlet configuration, wherein said inlet adapter is configured to be removed, inverted, and replaced;

said rotational component generally aligning with said inlet opening in said low-inlet configuration and generally being located below said inlet opening in said high-inlet configuration;

said inlet adapter including first and second ends and an inlet passage located at one of said ends and communicating with said inlet opening; and said inlet adapter being configured for inverting between said low-inlet and said high-inlet configurations.

12. The reconfigurable pump according to claim 11, which includes:

a check valve located in said housing interior with said pump in its low-inlet configuration; and said check valve being configured for blocking backflow through said inlet opening.

13. The reconfigurable pump according to claim 12, which includes:

said check valve including a pivot pin extending transversely across said housing interior over said inlet opening and a flapper valve pivotally mounted on said pivot pin, said flapper valve having open and closed positions relative to said inlet opening.

14. The reconfigurable pump according to claim 13 wherein said flapper valve is configured for removal from said inlet adapter with said pump in its high-inlet configuration.

15. The reconfigurable pump according to claim 11, which includes:

said pump type comprising a centrifugal pump;

an impeller rotatably mounted in said housing interior;

said impeller being configured for connection to a rotary power source; and said impeller being configured for pumping fluid from said inlet opening, through said housing interior and out said discharge opening.

16. A reconfigurable, centrifugal pump with low-inlet and high-inlet configurations, the pump comprising:

a housing with an exterior and an enclosed housing interior;

an inlet opening from said housing exterior to said housing interior;

a discharge opening from said housing interior to said housing exterior;

a rotational component rotatably mounted in said housing interior and configured for pumping fluid from said inlet opening to said discharge opening;

an inlet adapter mounted on said housing in covering relation over said inlet opening and reconfigurable between a low-inlet configuration and a high-inlet configuration;

said rotational component generally aligning with said inlet opening in said low-inlet configuration and generally being located below said inlet opening in said high-inlet configuration;

said inlet adapter including first and second ends and an inlet passage located at one of said ends and communicating with said inlet opening;

said inlet adapter being selectively configured for inverting between said low-inlet and said high-inlet configurations, wherein said inlet adapter is configured to be removed, inverted, and replaced;

a check valve located in said housing interior with said pump in its low-inlet configuration;

said check valve being configured for blocking backflow through said inlet opening;

said check valve including a pivot pin extending transversely across said housing interior over said inlet opening and a flapper valve pivotally mounted on said pivot pin, said flapper valve having open and closed positions relative to said inlet opening;

said flapper valve being configured for removal from said inlet adapter with said pump in its high-inlet configuration;

an impeller rotatably mounted in said housing interior;

said impeller being configured for connection to a rotary power source; and said impeller being configured for pumping fluid from said inlet opening, through said housing interior and out said discharge opening.

* * * * *